US005748567A

United States Patent [19]

Mori et al.

[11] Patent Number: 5,748,567

[45] Date of Patent: May 5, 1998

[54] ACCELERATION SENSOR

[75] Inventors: Masatomo Mori; Masahiro Nezu, both of Saitama; Tadao Matsunaga, Miyagi; Rokurou Naya, Kanagawa; Shougo Suzuki, Kanagawa; Akihiro Azuma, Kanagawa, all of Japan

[73] Assignees: Akebono Brake Industry Co., Ltd., Tokyo; Nihon Inter Electronics Corporation, Kanagawa, both of Japan

[21] Appl. No.: 721,579

[22] Filed: Sep. 25, 1996

[30] Foreign Application Priority Data

Dec. 20, 1995 [JP] Japan ..... 7-331700

[51] Int. Cl.[6] ..... H04R 17/00

[52] U.S. Cl. ..... 367/178; 367/180; 367/163; 310/329; 310/330; 73/652

[58] Field of Search ..... 367/178, 180, 367/163, 174; 310/329, 330; 73/652

[56] References Cited

U.S. PATENT DOCUMENTS 5,415,043 5/1995 Zabler ..... 73/704

5,571,972 11/1996 Okada ..... 73/862.043

5,656,778 8/1997 Roszhart ..... 73/504.04

5,679,895 10/1997 von Windheim ..... 73/514.25

*Primary Examiner*—J. Woodrow Eldred

*Attorney, Agent, or Firm*—Morgan, Lewis & Bockius LLP

[57] ABSTRACT

An acceleration sensor is based on a semiconductor technique which is suitable for mass production. The resulting acceleration sensor is small in size and high in precision. The acceleration sensor includes a stationary section, an acting section to which a force is applied in response to acceleration, a flexible section through which the stationary section is coupled to the acting section, a plurality of distortion sensing elements coupled to the flexible section, a first weight having a bottomed hole which is gradually smaller in width towards the bottom of the hole, the first weight being coupled to the acting section and a second weight, greater in specific gravity than the first weight, coupled to the bottom of the hole of the first weight.

20 Claims, 10 Drawing Sheets

ACCELERATION SENSOR

BACKGROUND OF THE INVENTION

1. Field of the Invention

The present invention relates to a method of manufacturing an acceleration sensor according to a micro-machining technique. The present invention also relates to an acceleration sensor which is manufactured according to the method involving the micro-machining technique.

2. Discussion of the Related Art

A known acceleration sensor includes a piezo-electric resistance element formed on a semiconductor substrate. Mechanical variation of the piezo-electric resistance element caused by the application of an external force (such as acceleration thereto) is detected as a variation in electrical resistance. This allows the detection of the magnitude of the external force. A conventional acceleration sensor of this type is shown in FIGS. 12 and 13. This type of acceleration sensor is disclosed, for example, by Japanese Patent Application (unexamined publication application) No. 2535/1990.

FIG. 12 is a cross-sectional view of the conventional acceleration sensor. FIG. 13 is a plan view showing the arrangement of piezo-electric resistance elements on the semiconductor substrate. As shown in FIG. 12, the acceleration sensor is formed by accommodating an acceleration sensor element or element section 1 in a package 40. The element section 1, comprises a semiconductor pellet 10, a weight 21, a supporting seat 22, a lower limit board 30, and an upper limit board 50.

The semiconductor pellet 10 includes an acting section 11 at a central position and an annular groove 14 formed around the acting section 11. Annular grove 14 provides a flexible section 12, which is accordingly smaller in thickness. Semiconductor pellet 10 also includes a stationary section 13 surrounding the flexible section 12. Piezo-electric resistance elements 15 (or RX1 through RX4, RY1 through RY4, and RZ1 through RZ4) are arranged on the flexible section 12, as shown in FIG. 13.

The weight 21 is joined to the lower surface of the acting section 11. The lower surface of the stationary section 13 is joined to the upper surface of the supporting seat 22.

The lower surface (bottom surface) of the seat 22 is joined through the lower limit board 30 to the inner bottom surface of the package 40. The semiconductor pellet 10 and the weight 21 are supported by the supporting seat 22. The package 40 is covered with a lid 43.

The aforementioned resistance elements are electrically connected to bonding pads 16 which, in turn, are connected through bonding wires 42 to lead wires 41 provided on the sides of the package.

The upper limit board 50 and the lower limit board 30 have shallow recesses 38 and 51, respectively, which function to limit the vertical displacement of the weight 21 to within a certain allowable range.

Upon application of acceleration to the acceleration sensor, the external force acts on the weight 21. That is, the external force is applied through the acting section 11 to the flexible section 12 thereby to deform the flexible section. As a result, the resistance elements 15 formed on the flexible section 12 are varied in electrical resistance. The amount of variation in electrical resistance is processed to detect the direction and magnitude of the acceleration.

A method of manufacturing the above-described acceleration sensor will be described with reference to FIGS. 14(A) through 14(E).

First, a semiconductor substrate is prepared. Next, the piezo-electric resistance elements 15 are formed in a desired pattern on one surface of the substrate. Then, annular grooves 14 are formed in the other surface of the substrate by etching. As a result, the semiconductor pellet 10 having the acting sections 11, the flexible sections 12, and the stationary sections 13, is formed. This structure is shown in FIG. 14(A).

Next, an auxiliary substrate 20 of semiconductor or glass is prepared. The auxiliary substrate 20 has horizontal and vertical grooves 25 so that it is divided into sections corresponding to weights 21 and supporting seats 22. Thereafter, the lower surfaces of the stationary sections 13 of the semiconductor pellet 10 are joined to the upper surfaces of the supporting seats 22, and the lower surfaces of the acting sections 11 are joined to the upper surfaces of the weights 21, as shown in FIG. 14(B). Under this condition, the bottoms of the grooves 25 of the auxiliary substrate 20 are cut with a dicing blade to form cut grooves 26 therein, so that the weights 21 are separated from the supporting seats 22, as shown in FIG. 14(C). Thus, the weights 21 are hung from the acting sections 11 in such a manner that they are freely movable with respect to the supporting seats 22 with the aid of the flexible sections 12.

Next, the lower limit board 30 having recesses 38 corresponding to the positions of the weights 21 is formed, and the lower surfaces of the supporting seats 22 of the auxiliary substrate 20 are joined to the upper surfaces of the lower limit board 30, as shown in FIG. 14(D). Thereafter, an upper limit board 50 having shallow recesses 51 corresponding to the upper surfaces of the flexible sections of the semiconductor pellet 10 is prepared. Then, the upper surfaces of the stationary sections 13 of the semiconductor pellet 10 are joined to the periphery of the upper limit board 50. Under this condition, cut grooves 52 are formed between the elements with a dicing blade. The final result, as shown in FIG. 14(E), is the manufacture of a set of aimed acceleration sensors 1.

As described above, in the manufacture of the conventional acceleration sensor, the silicon substrate providing the supporting seat 22, and the auxiliary substrate 20 made of glass, are cut. Hence, the acceleration sensor is small in mass, and low in sensitivity. The sensitivity of the acceleration sensor may be improved by increasing the weight of the weight 21 (for example, by increasing the size of the weight). However, such modification is disadvantageous in that the sensor is increased not only in volume, but also in manufacturing cost.

The above-described difficulties may be eliminated by a method in which the weight 21 is formed individually, by using a heavy material such as a metal material high in specific gravity, and joined to the acting section 11. However, this method can give rise to other problems. In such manufacture of the acceleration sensor, for example, it is necessary to additionally provide a step of joining the weight 21 to the acting section 11. Therefore, it is difficult to manufacture the acceleration sensor on a single manufacturing line. In other words, the acceleration sensor is not suitable for mass production. Furthermore, in this method, it is difficult to achieve the joining of the weight to the acting section with high accuracy. That is, the center of gravity of the weight is likely to be shifted with respect to the acting section. This difficulty is likely to adversely affect the interference output and fluctuate the output of the acceleration sensor depending on the direction of the acceleration. In the latter case, it is necessary to take steps to correct the fluctuation of the output of the sensor.

When the weight 21 is made of a metal material, the acceleration sensor suffers from the following. Because the weight 21 is different in thermal expansion coefficient from the acting section 11, the acting section 11 to which the weight 21 has been joined is strained by a variation in ambient temperature. The flexible section 12 is, therefore, adversely affected, and the temperature characteristic of the acceleration sensor is lowered.

SUMMARY OF THE INVENTION

Accordingly, the present invention is directed to an acceleration sensor that substantially obviates one or more of the problems due to limitations and disadvantages of the prior art.

An object of the invention is to provide an acceleration sensor that eliminates above-described difficulties accompanying a conventional acceleration sensor, is suitable for mass production, and which is high in precision.

Another object of the invention is to provide an acceleration sensor that is small in size, high in structural accuracy, and high in sensitivity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages, and in accordance with the purpose(s) of the present invention, as embodied and broadly described, the acceleration sensor includes a stationary section; an acting section to which a force is applied in response to acceleration; a flexible section through which the stationary section is coupled to the acting section; a plurality of distortion sensing elements coupled to the flexible section; a first weight having a hole with a bottom which is gradually smaller in width towards the bottom of the hole, the first weight being coupled to the acting section; and a second weight, greater in specific gravity than the first weight, coupled to the bottom of the hole of the first weight.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention. In the drawings.

DETAILED DESCRIPTION OF PREFERRED EMBODIMENTS

Figure 1:
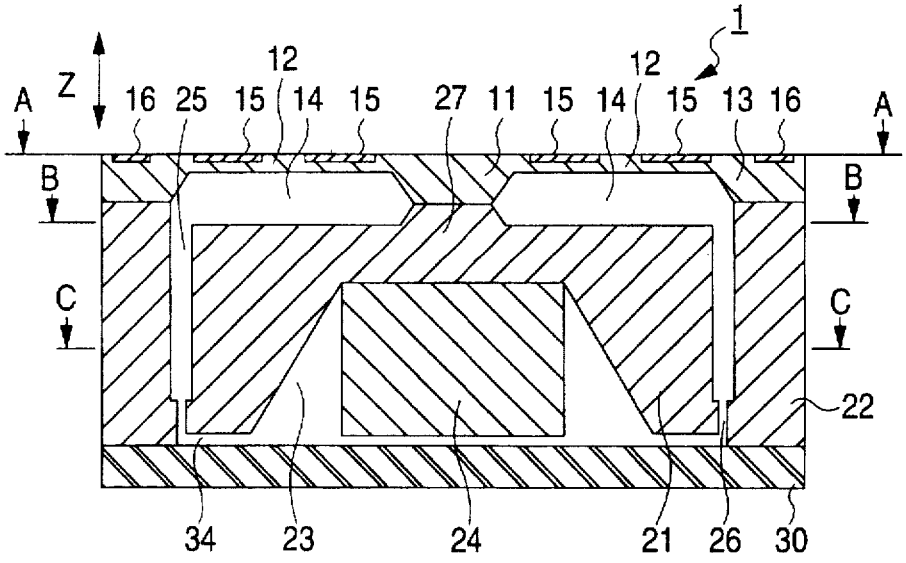
FIG. 1 is a cross-sectional view outlining the structure of an example of an acceleration sensor according to a first embodiment of the invention.

Reference will now be made in detail to the preferred embodiments of the present invention, examples of which are illustrated in the accompanying drawings. For ease of reference, the same reference numerals will be used throughout the various drawings to designate the same or like components.

First Embodiment

Figure 2:
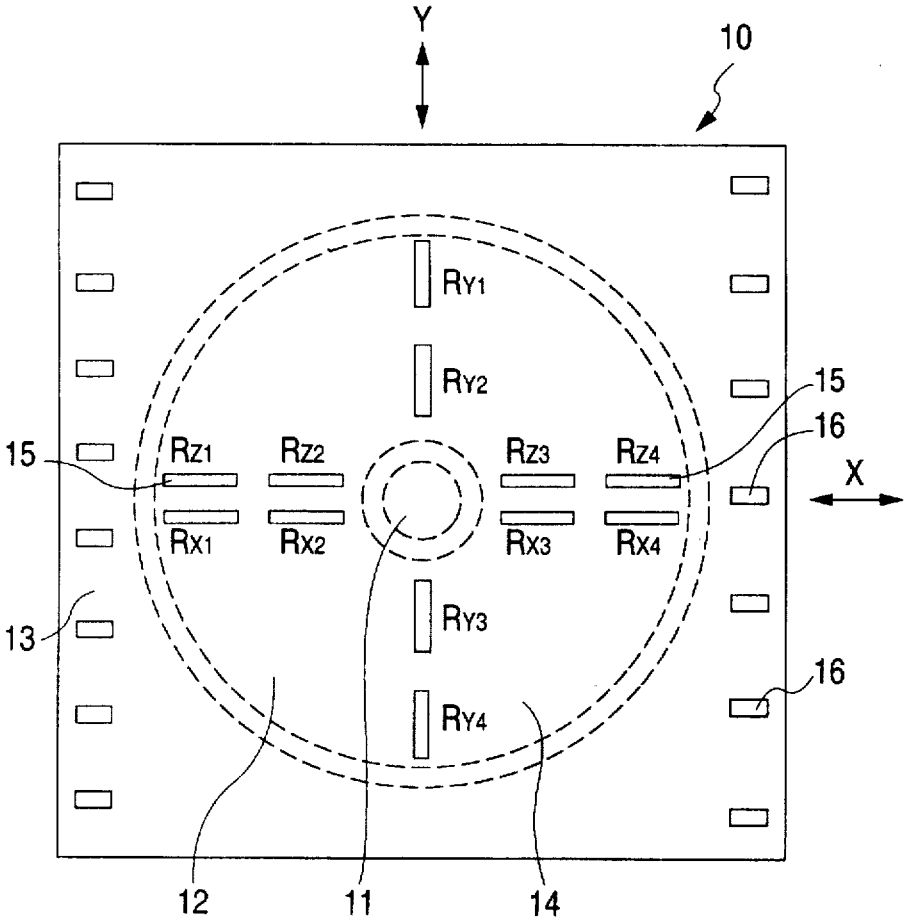
FIG. 2 is a top view of a semiconductor pellet taken in the direction of the arrows substantially along line A—A in FIG. 1.
Figure 3:
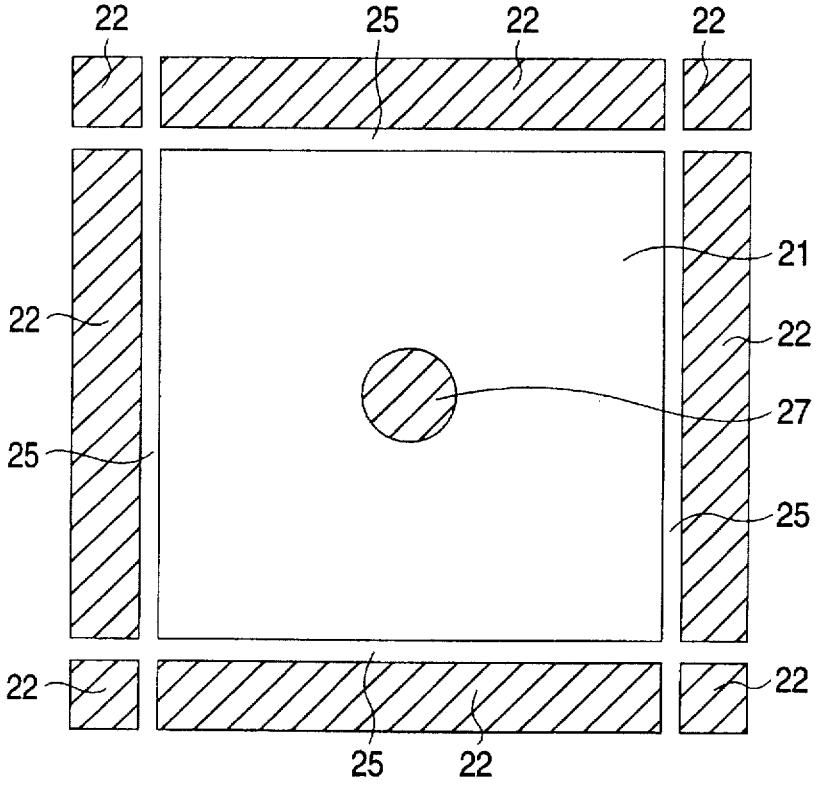
FIG. 3 is a sectional view of the acceleration sensor of the first embodiment taken along line B—B in FIG. 1.
Figure 4:
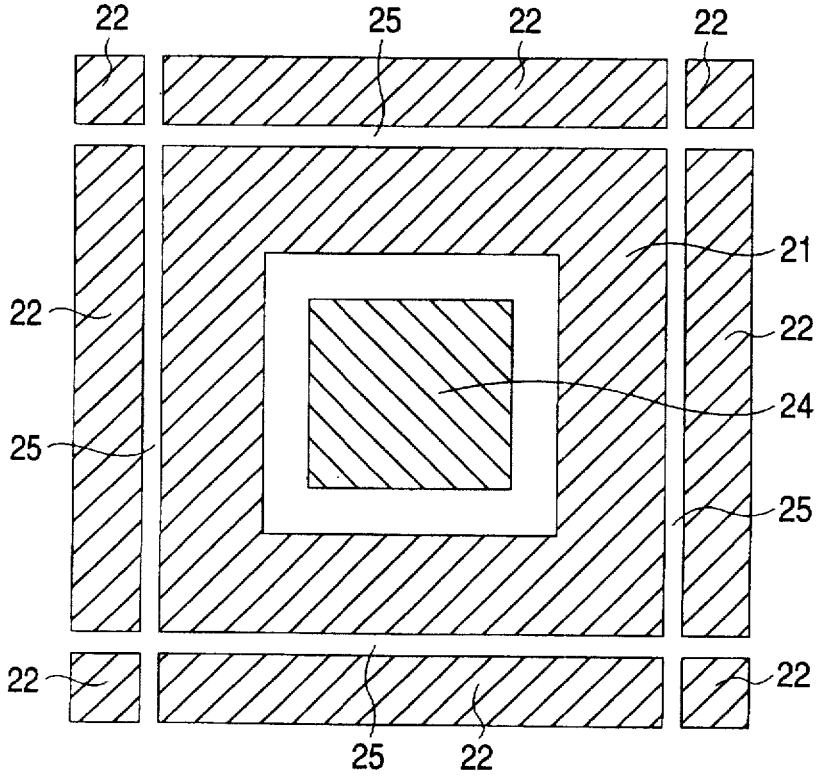
FIG. 4 is a sectional view of the acceleration sensor of the first embodiment taken along line C—C in FIG. 1.
Figure 5:
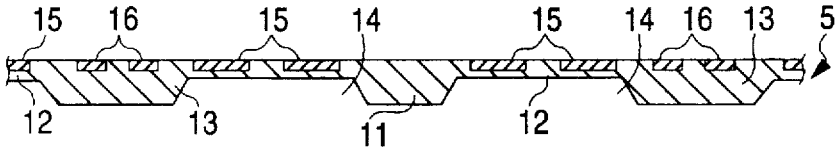
FIGS. 5(A) through (E) and FIGS. 6(A) through 6(C) are cross-sectional views describing a method of manufacturing an acceleration sensor according to the first embodiment of the invention.
Figure 5:
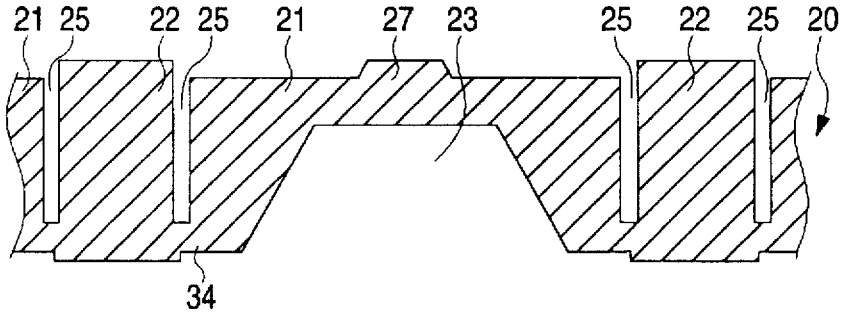
Figure 5:
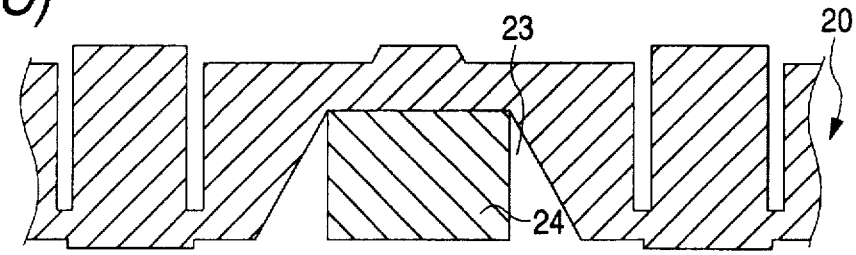
Figure 5:
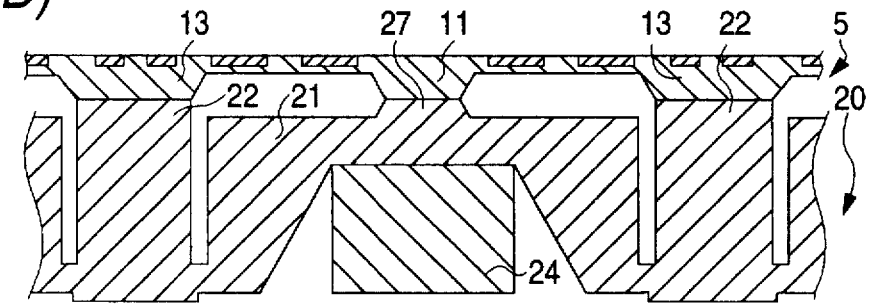
Figure 5:
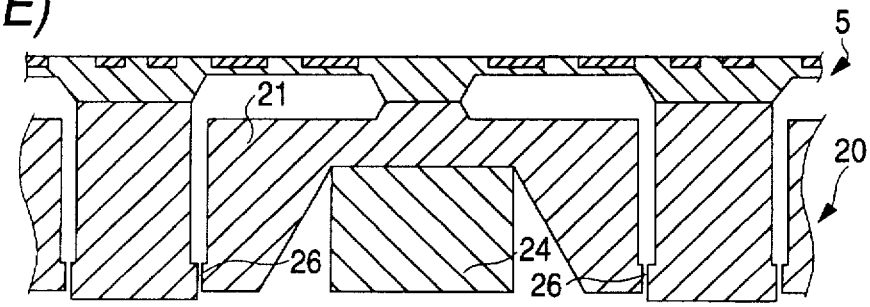
Figure 6:
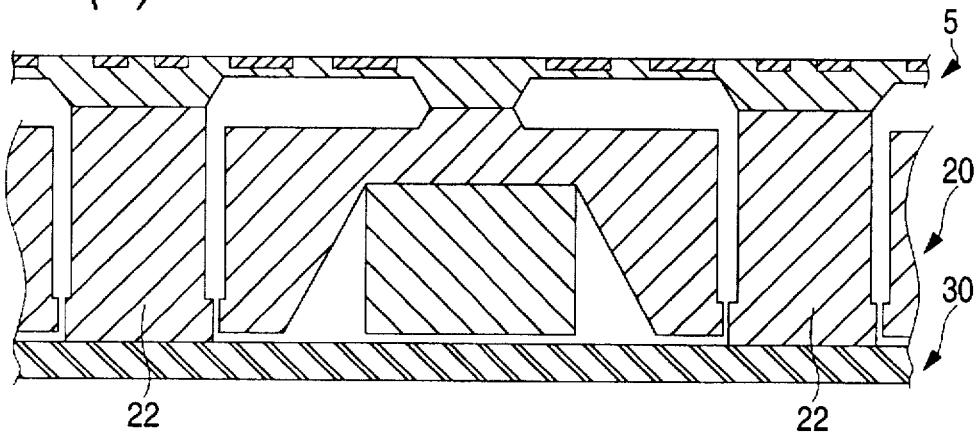
Figure 6:
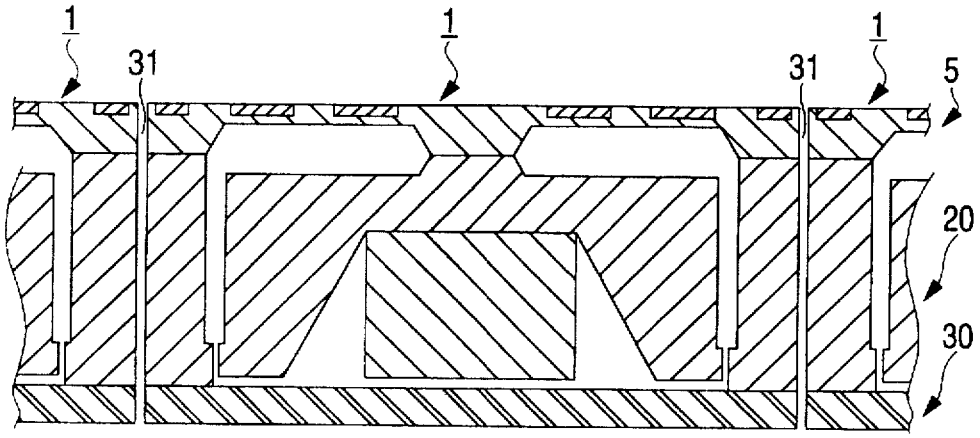
Figure 6:
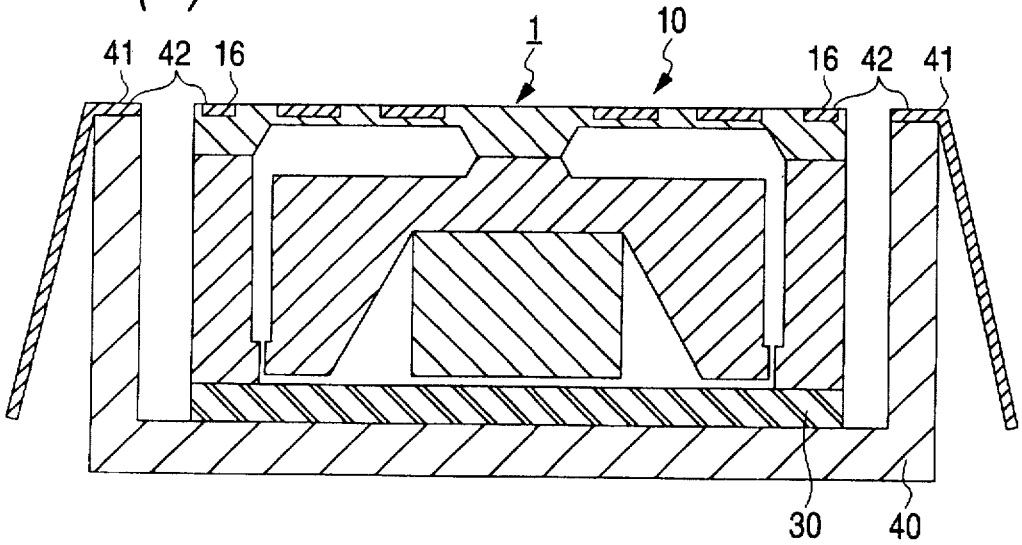

An example of an acceleration sensor according to a first embodiment of the invention will be described with reference to FIGS. 1 through 4. FIG. 1 is a cross-sectional view of the acceleration sensor of the invention. FIG. 2 is a plan view of a semiconductor pellet in the acceleration sensor as viewed in the direction of the arrows substantially along lines A—A in FIG. 1. FIG. 3 is a sectional view taken along line B—B in FIG. 1. FIG. 4 is a sectional view taken along line C—C in FIG. 1, showing the positional relationships between a first weight and a second weight, which is made of metal.

A specific feature of the acceleration sensor according to the invention is that a first weight 21 has a second weight 24 made of metal being greater in specific gravity than the first weight (hereinafter referred to as "a metal weight 24" when applicable) at its center. That is, the first weight 21 and the second weight 24 together form a weight assembly that is accordingly heavier than the first weight 21 by itself.

The acceleration sensor of the first embodiment of the invention comprises a semiconductor pellet 10, the first weight 21, a supporting seat 22, and a lower limit board 30.

The semiconductor pellet has an acting section 11 at its center, an annular groove 14 formed around the acting section 11, thus providing a flexible section 12 which is accordingly smaller in thickness, and a stationary section 13 surrounding the flexible section 12. As shown in FIG. 2, piezo-electric resistance elements 15 (or RX1 through RX4, RY1 through RY4, and RZ1 through RZ4) are formed on the upper surface of the flexible section 12, and bonding pads 16 are formed on the upper surface of the stationary section 13. The piezo-electric resistance elements 15 are electrically connected through a wiring pattern (not shown) to the bonding pads 16.

The first weight 21 is joined to the lower surface of the acting section 11 of the semiconductor pellet 10, and the lower surface of the stationary section 13 is joined to the upper surface of the supporting seat 22. The lower surface of the supporting seat 22 is joined to the lower limit board 30.

The bottom surface of the first weight 21 is formed by slightly etching an auxiliary substrate, described in greater detail below, so that a gap or recess 34 is provided between the first weight 21 and the lower limit board 30.

In the lower surface of the first weight 21, a rectangular bottomed hole 23 (hereinafter referred to as "an etching hole 23", when applicable) is opened by etching such that it is gradually smaller in width towards the bottom. The bottom of the etching hole 23 is substantially equal in configuration to the upper surface of the second weight 24.

The upper surface of the second weight 24 is joined to the bottom of the first weight 21 at the location of the etching hole 23. The second weight 24 is automatically and accurately positioned in place when it is pushed into the etching hole 23 of the first weight 21.

Other features of the first embodiment of the invention include grooves 25, cut grooves 26, and mounting sections 27.

A method of manufacturing the acceleration sensor according to the first embodiment of the invention will be described with reference to FIGS. 5(A) through (E), 6(A) through (C), 7, and 8.

First, a semiconductor substrate 5 of silicon, or the like, is prepared. The piezo-electric resistance elements 15 and the bonding pads 16 (FIG. 2) are formed on the upper surface of the semiconductor substrate.

Figure 7:
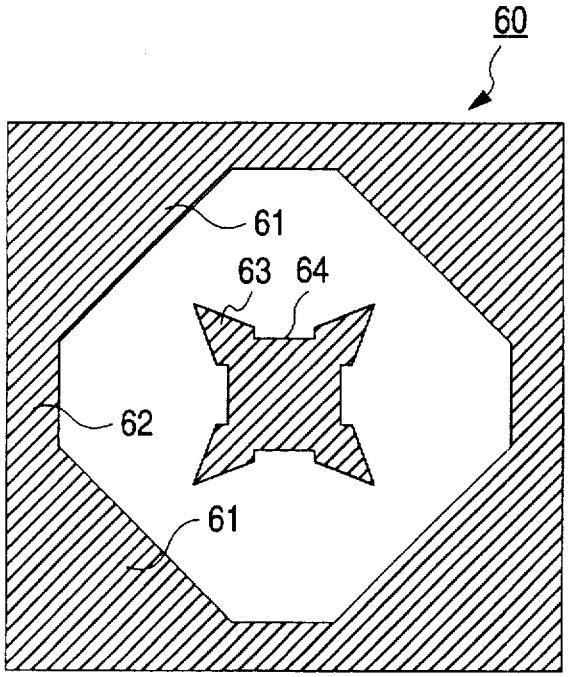
FIG. 7 is a plan view illustrating a configuration of a mask pattern used for formation of a diaphragm in the sensor of the invention.

Next, using a mask pattern 60 as shown in FIG. 7 formed on the lower surface of the semiconductor substrate 5, the semiconductor substrate is subjected to anisotropic etching to form the annular groove 14 therein. Reference numerals 61, 62, 63, and 64 of FIG. 7 designate components relating to mask pattern 60. As a result, a semiconductor substrate 5 having a plurality of semiconductor pellets 10 is obtained, as shown in FIG. 5(A). Flexible sections 12 and stationary sections 13 can also be seen in FIG. 5(A)

An auxiliary substrate 20 of semiconductor material, such as silicon, is also prepared. The upper surface of the substrate 20 is subjected to anisotropic etching in order to form a plurality of mounting sections 27. It is preferable that the auxiliary substrate 20 is of a material such as silicon or glass that can be processed with ease and is substantially equal in thermal expansion coefficient to silicon. Each of the mounting sections 27 is formed in such a manner so as to confront a respective acting section 11, so that it can be joined to the acting section.

A plurality of substantially square recesses 34 are formed in the lower surface of the auxiliary substrate 20 by anisotropic etching. Then, the etching holes 23 are formed also by anisotropic etching such that each of the mounting sections 27 is located at the center thereof.

Figure 8:
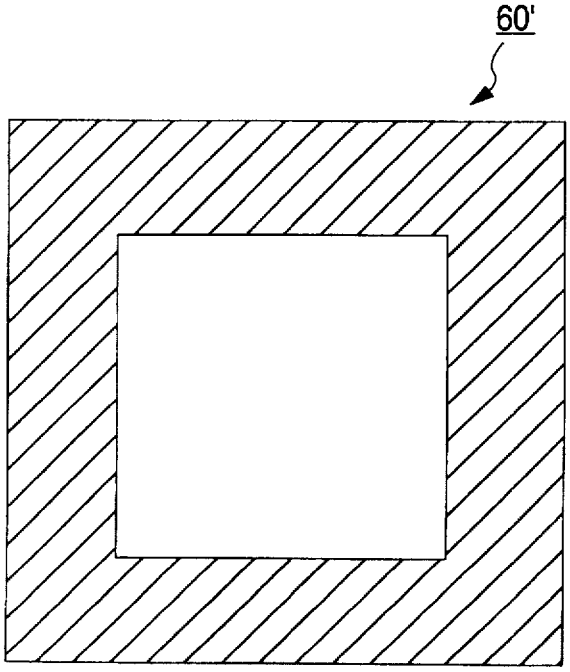
FIG. 8 is a plan view illustrating a configuration of a mask pattern for formation of an etching hole in the sensor of the invention.

That is, the bottomed holes are formed by subjecting the (100) face of the auxiliary substrate 20 to anisotropic etching with a mask pattern 60' as shown in FIG. 8. The resultant etching hole 23 is in the form of a frustum of a pyramid having four sloped surfaces of approximately 55°.

Separating grooves 25 are cut in the upper surface of the auxiliary substrate 20 using a dicing blade, as shown in FIG. 5(B). Also shown in FIG. 5(B) are first weights 21 and supporting seats 22.

Next, the second weights 24, which are formed separately, are joined to the bottoms of the etching holes 23 in the auxiliary substrate 20, respectively, as shown in FIG. 5(C). In this operation, since the side walls of each etching hole 23 are sloped, each second weight 24 is automatically guided and positioned in place by the side walls when dropped into the corresponding etching hole 23.

It is preferable that the second weights 24 are great in specific gravity and small in thermal expansion coefficient. Hence, preferably the second weights 24 are made of tungsten or molybdenum.

The second weight 24 is joined to the auxiliary substrate 20, for example, by glass bonding. However, the invention is not limited thereto or thereby. That is, each second weight 24 may be joined to auxiliary substrate 20 by using any material that withstands a heat treatment (which is performed later) and has a small thermal expansion coefficient.

Next, the semiconductor substrate 5 and the auxiliary substrate 20 are positioned to oppose each other and are then positioned so that the acting sections 11 oppose the mounting sections 27 while the stationary sections 13 oppose the supporting stands 22. Under this condition, the semiconductor substrate 5 and the auxiliary substrate 20 are bonded together, for example, by anodic bonding, as shown in FIG. 5(D). As a result, the second weights 24 are joined through the first weights 21 to the acting sections 11 of the semiconductor pellets 10, respectively, while the stationary sections 13 are joined to the supporting seats 22.

Next, the bottom of the auxiliary substrate 20 is cut with the dicing blade to form cut grooves 26 that extend from the aforementioned grooves 25, respectively. Consequently, the first weights 21 are separated from the supporting seats 22, as shown in FIG. 5(E). As a result, the first weights 21 are supported only by the flexible sections 12.

Thereafter, the bottoms of the supporting seats 22 are joined to the lower limit board 30 made of glass or silicon, as shown in FIG. 6(A) Under this condition, cut grooves 31 are formed in the semiconductor substrate 5, the auxiliary substrate 20, and the lower limit board 30, to form a plurality of semiconductor pellets 10 and, accordingly, a plurality of acceleration sensor elements 1, as shown in FIG. 6(B).

Each of the acceleration sensor elements 1 thus formed is fixedly accommodated in a package 40. The bonding pads 16 of element 1 are connected through bonding wires 42 to the leads 41 of the package 40 to thereby form the aimed acceleration sensor, as shown in FIG. 6(C).

According to the above-described acceleration sensor manufacturing method, the manufacturing steps shown in FIGS. 5(A) through 6(B) are performed batchwise. In this way, the acceleration sensor can be mass-produced at a low manufacturing cost.

In the acceleration sensor thus formed, the movement of the weight 21 in the directions of the X-axis, the Y-axis, and the Z-axis, is limited by the contact of the weight 21 with the supporting seat 22 or the lower limit board 30 or by the viscosity of the fluid held between them. Hence, the weight 21 is protected from excessive shock.

Second Embodiment

Figure 9:
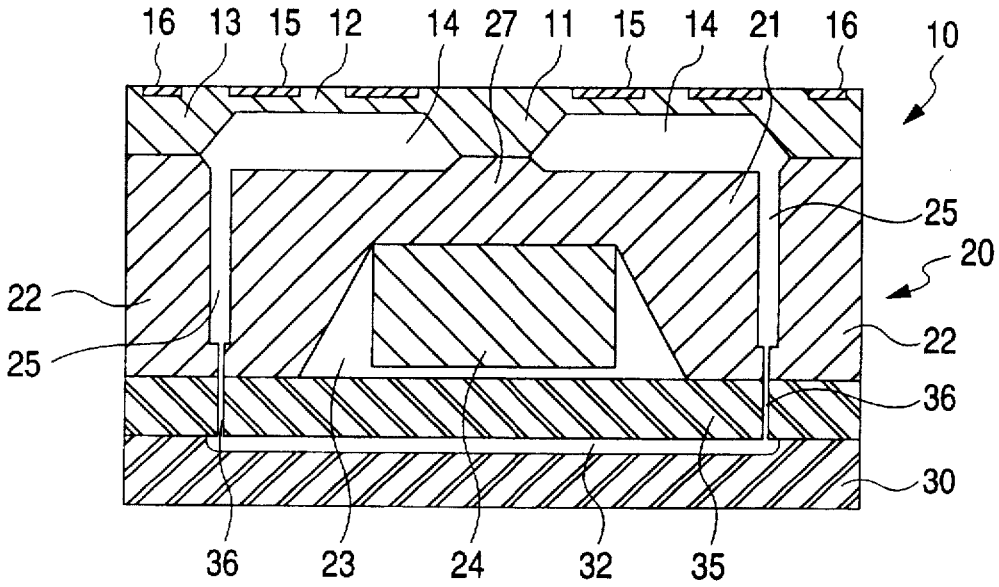
FIG. 9 is a cross-sectional view outlining the structure of another example of an acceleration sensor according to a second embodiment of the invention.

FIG. 9 shows another example of the acceleration sensor corresponding to a second embodiment of the invention. This acceleration sensor has an improved damping effect.

A specific feature of the second embodiment resides in that the opening of the etching hole of the first weight 21 is closed with a cover board 35 made of glass or silicon, and the lower limit board 30 is provided under the cover board 35. The lower limit board 30 has a shallow recess 32 that is slightly larger in area than the bottom of the first weight 21. Cut grooves 36 are located between grooves 25 and shallow recess 32.

In the second embodiment, the etching hole 23 is covered with the cover board 35 and, as a result, its damping area S is increased and the damping effect is markedly improved.

The damping effect is proportional to the viscous force F which is represented by the following Equation (1):

$$F=\mu S\ V/d \quad (1)$$

where μ is the viscous coefficient of the fluid; S is the damping area (in which the lower surface of the cover board 35 opposes the lower limit board 30); d is the distance between the cover board 35 and the lower limit board 30; and V is the velocity.

With the above-described arrangement, the weight 21 is prevented from resonance, and is improved in shock resistance. Furthermore, the acceleration sensor can be limited in detecting frequency. Hence, for example, when the acceleration sensor is employed as a sensor for an anti-skid brake system (ABS), frequencies higher than 20 Hz can be limited. Consequently, the weight is further improved in shock resistance.

Third Embodiment

Another example of the acceleration sensor that corresponds to a third embodiment of the invention will be described with reference to FIGS. 10(A) through 10(C) and 11(A) through 11(C).

A specific feature of the third embodiment is that the second weight 24 is provided in the space formed between two wafers.

Figure 10:
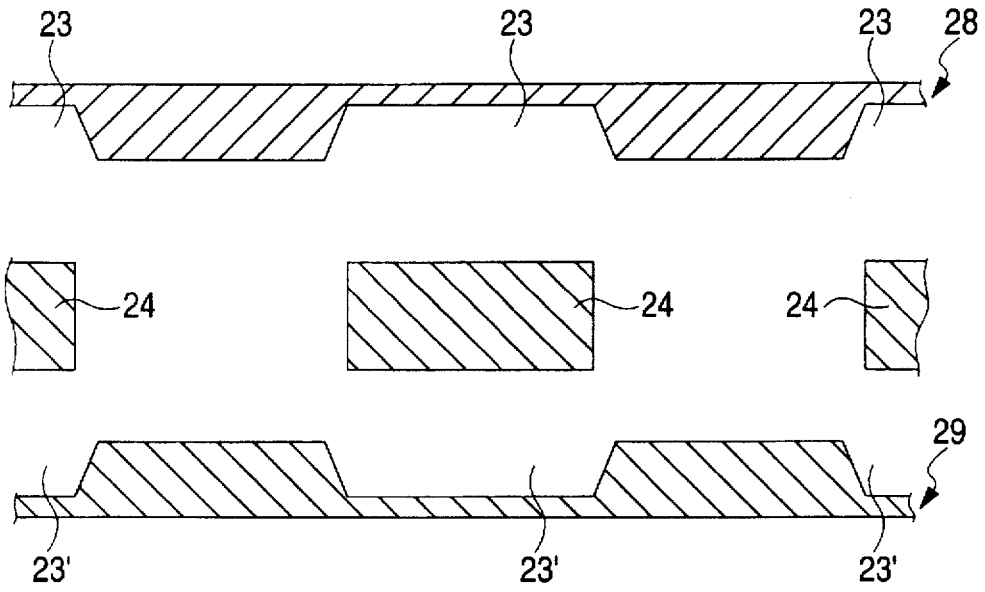
FIGS. 10(A) through (C) and FIGS. 11(A) through (C) are cross-sectional views describing a method of manufacturing another example of an acceleration sensor according to a third embodiment of the invention.
Figure 10:
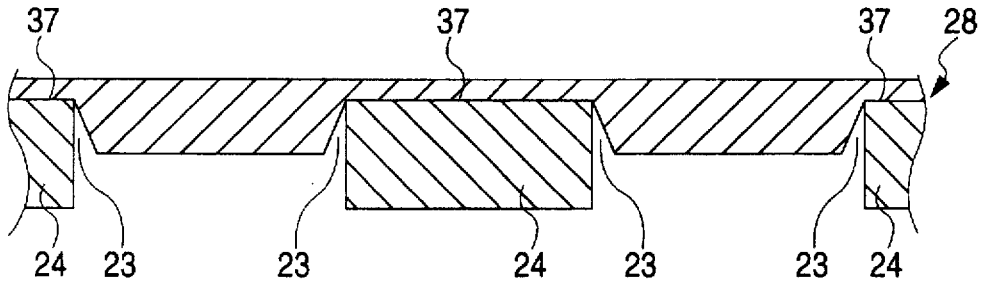
Figure 10:
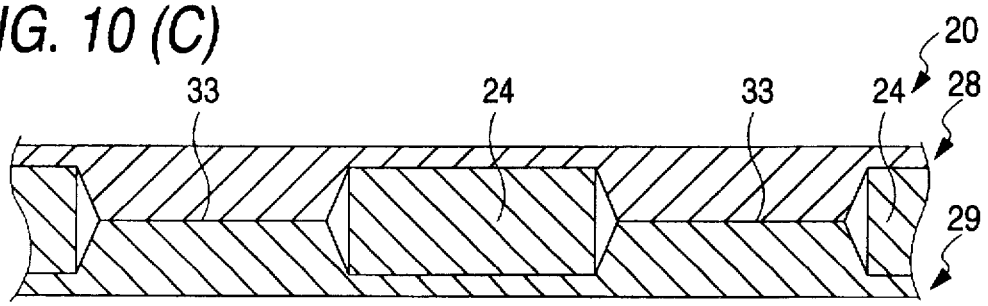

First, a first wafer 28, a second wafer 29, and a second weight 24 are prepared, as shown in FIG. 10(A). The first wafer 28 has the same etching holes 23 (hereinafter referred to as "weight spaces 23", when applicable) as found in the first embodiment. The second wafer 29, being symmetrical with the first wafer 28, has the same etching holes 23' (hereinafter referred to as "weight spaces 23'", when applicable) as the first wafer 28.

Next, the second weight 24, which is made of tungsten or the like, is joined to the bottom surface 37 of each of the etching holes 23 such that it is positioned in place as shown in FIG. 10(B). The joining of the second weight 24 to the bottom of the etching hole 23 may be achieved, for example, by glass bonding.

Thereafter, the lower surfaces of the first wafer 28 are joined to the upper surfaces of the second wafer 29 as indicated at abutting point or surface 33 in FIG. 10(C). The joining of the first wafer 28 to the second wafer 29 may be achieved by anodic bonding or glass bonding.

Thus, an auxiliary substrate 20 including the first and second weights may be formed in this manner.

Under this condition, separating grooves 25 are formed in the upper surface of the auxiliary substrate 20 so that the auxiliary substrate is divided into parts. In this connection, the formation of the separating grooves 25 forms supporting seats 22 in the auxiliary substrate 20. The stationary sections 13 and the acting sections 11 of the semiconductor pellet 10, which are equivalent to those in the first embodiment, are joined to the upper surfaces of the supporting seats 22, as shown in FIG. 11(A).

Thereafter, cut grooves 26 are formed in the lower surface of the auxiliary substrate 20 such that the cut grooves extend to the separating grooves 25, respectively, so that the weights 21 are separated from the supporting seats 22. On the other hand, a lower limit board 30, having recesses 38 and peripheral protrusions 39, is prepared. Under this condition, the lower surfaces of the supporting seats 22 are joined to peripheral protrusions 39 of the lower limit board 30, as shown in FIG. 11(B).

Figure 11:
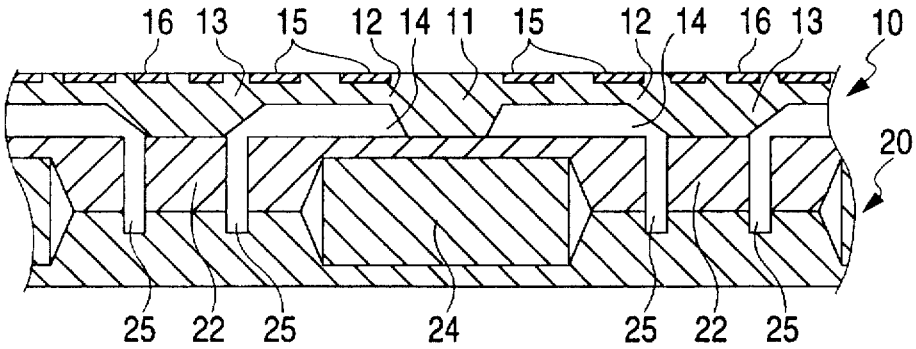
Figure 11:
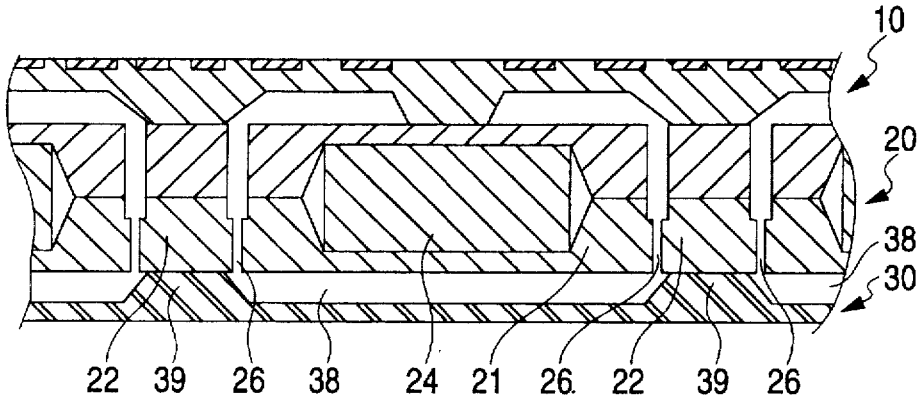
Figure 11:
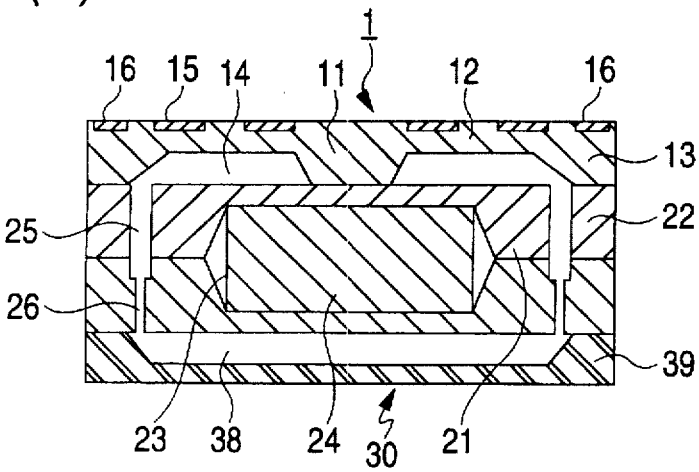
Figure 12:
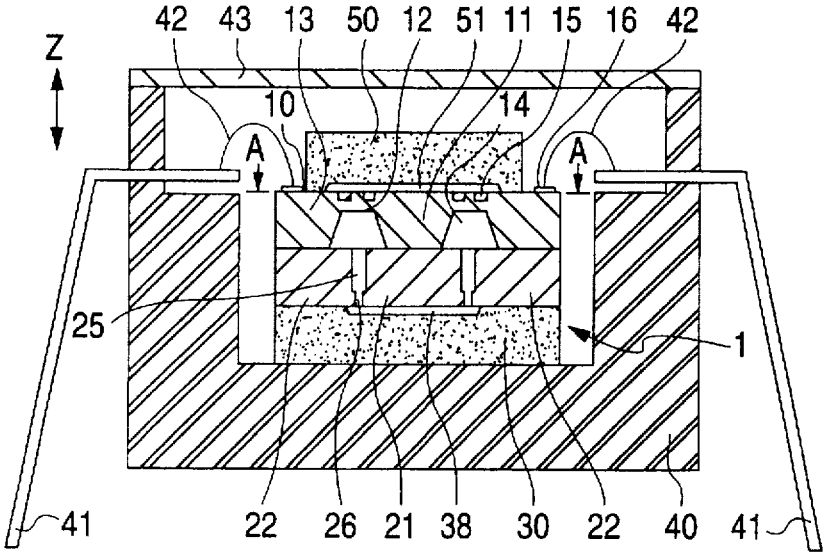
FIG. 12 is a cross-sectional view outlining the structure of a conventional acceleration sensor.
Figure 13:
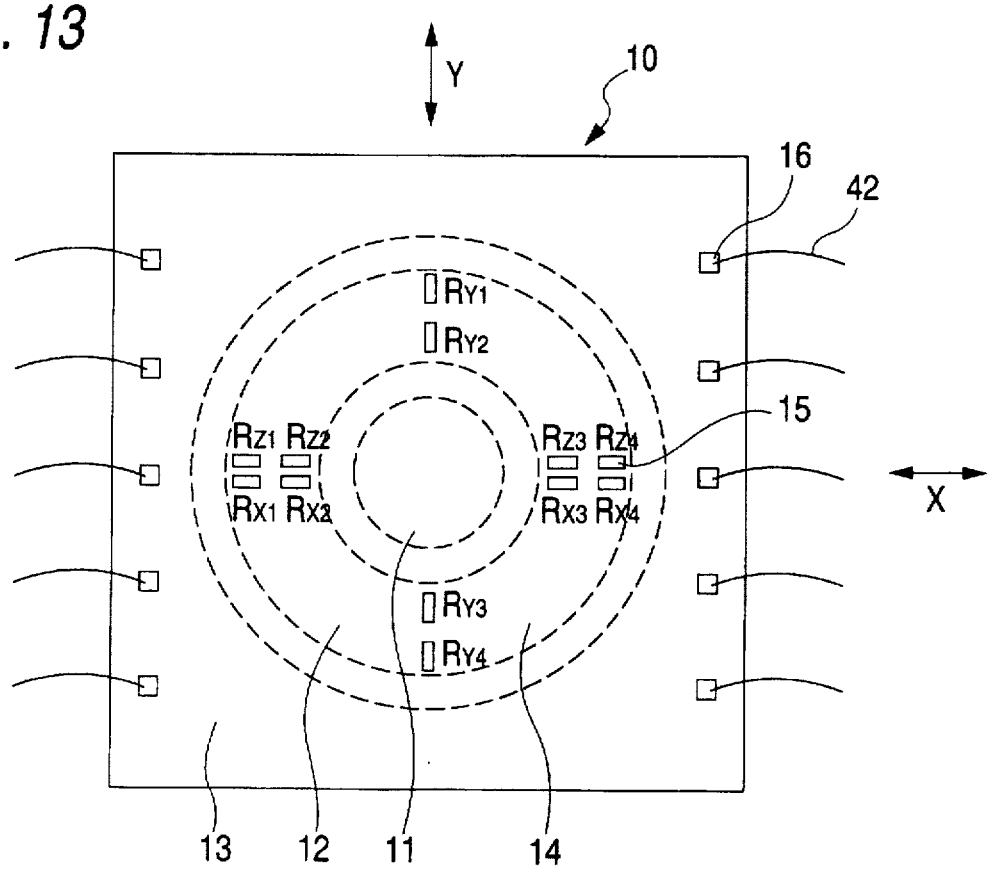
FIG. 13 is a plan view of a semiconductor pellet taken in the direction of the arrows substantially along line A—A in FIG. 12.
Figure 14:
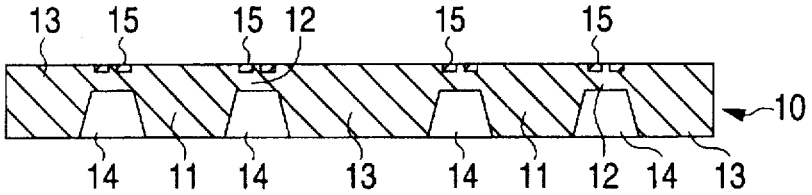
FIGS. 14(A) through (E) are cross-sectional views describing a method of manufacturing the conventional acceleration sensor.
Figure 14:
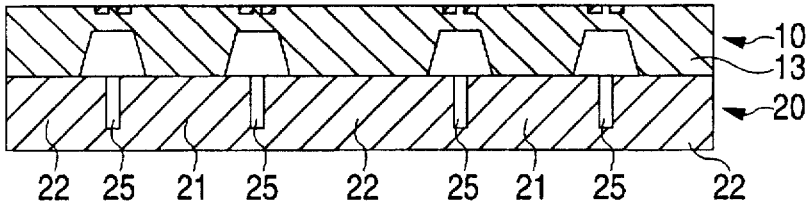
Figure 14:
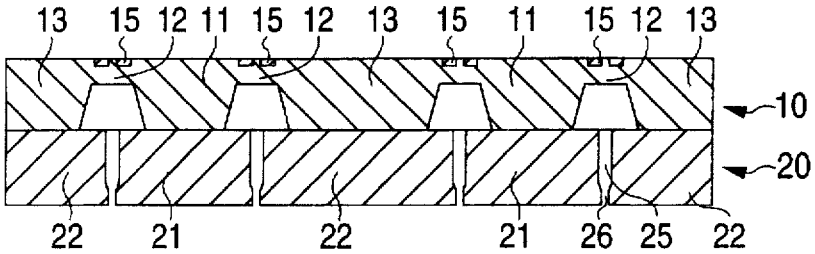
Figure 14:
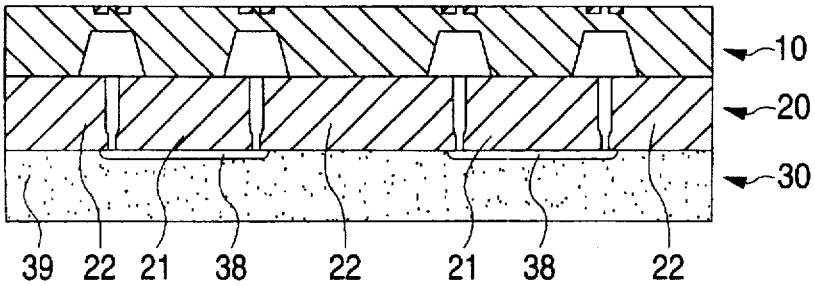
Figure 14:
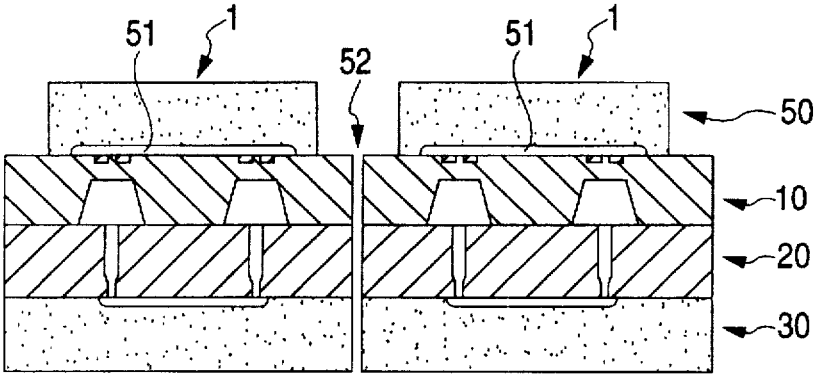

Thereafter, the stationary sections 13 of the semiconductor pellet 10, the supporting seats 22 of the auxiliary substrate 20, and the peripheral protrusions 39 of the lower limit board 30, are cut to obtain a plurality of acceleration sensor elements 1 (see, for example, FIG. 11(C)).

Effect(s) of the Invention

As was described above, in the acceleration sensor of the invention, the weight is formed using a material that is large in specific gravity. This feature contributes to an improvement in sensitivity and to a reduction in size of the sensor.

Furthermore, in the acceleration sensor of the invention, it is possible to readily position and fix the second weight in place with high accuracy even though the second weight is large in mass. Hence, the acceleration sensor of the invention is suitable for mass production, small in size, and high in sensitivity.

Moreover, in the acceleration sensor of the invention, the weight which, being made of metal, is large in thermal expansion coefficient, is not directly joined to the acting section. Hence, the distortion of the acting section due to variations in temperature is minimized. That is, the sensor has improved temperature characteristics.

In addition, in at least the second and third embodiments, the damping effect is enhanced. Therefore, the sensor has improved frequency characteristic, and shock resistance.

It will be apparent to those skilled in the art that various modifications and variations can be made in the acceleration sensor of the present invention without departing from the spirit or scope of the invention. Thus, it is intended that the present invention cover the modifications and variations of this invention provided they come within the scope of the appended claims and their equivalents.

What is claimed is:

1. An acceleration sensor comprising:

a stationary section;

an acting section to which a force is applied in response to acceleration;

a flexible section through which the stationary section is coupled to the acting section;

a plurality of distortion sensing elements coupled to the flexible section;

a first weight having a hole with a bottom which is gradually smaller in width towards the bottom of the hole, the first weight being coupled to the acting section; and a second weight, greater in specific gravity than the first weight, coupled to the bottom of the hole of the first weight.

2. An acceleration sensor as claimed in claim 1, wherein the bottom of the hole of the first weight is substantially equal in configuration to a surface of the second weight.

3. An acceleration sensor as claimed in claim 1, wherein the bottomed hole is formed by subjecting a (100) face of an auxiliary substrate to anisotropic etching.

4. An acceleration sensor as claimed in claim 2, wherein the bottomed hole is formed by subjecting a (100) face of an auxiliary substrate to anisotropic etching.

5. An acceleration sensor as claimed in claim 1, wherein an opening of the bottomed hole is covered by a third weight.

6. An acceleration sensor as claimed in claim 2, wherein an opening of the bottomed hole is covered by a third weight.

7. An acceleration sensor as claimed in claim 3, wherein an opening of the bottomed hole is covered by a third weight.

8. An acceleration sensor as claimed in claim 4, wherein an opening of the bottomed hole is covered by a third weight.

9. An acceleration sensor as claimed in claim 1, wherein the first weight is formed from a portion of an auxiliary substrate which is separate from a supporting seat portion of the auxiliary substrate.

10. An acceleration sensor as claimed in claim 2, wherein the first weight is formed from a portion of an auxiliary substrate which is separate from a supporting seat portion of the auxiliary substrate.

11. An acceleration sensor as claimed in claim 3, wherein the first weight is formed from a portion of the auxiliary substrate which is separate from a supporting seat portion of the auxiliary substrate.

12. An acceleration sensor as claimed in claim 4, wherein the first weight is formed from a portion of the auxiliary substrate which is separate from a supporting seat portion of the auxiliary substrate.

13. An acceleration sensor as claimed in claim 5, wherein the first weight is formed from a portion of an auxiliary substrate which is separate from a supporting seat portion of the auxiliary substrate.

14. An acceleration sensor as claimed in claim 6, wherein the first weight is formed from a portion of an auxiliary substrate which is separate from a supporting seat portion of the auxiliary substrate.

15. An acceleration sensor as claimed in claim 7, wherein the first weight is formed from a portion of the auxiliary substrate which is separate from a supporting seat portion of the auxiliary substrate.

16. An acceleration sensor as claimed in claim 8, wherein the first weight is formed from a portion of the auxiliary substrate which is separate from a supporting seat portion of the auxiliary substrate.

17. An acceleration sensor comprising:

a stationary section;

an acting section for receiving a force resulting from an acceleration;

a flexible section for coupling the stationary section and the acting section;

a plurality of distortion sensing elements coupled to the flexible section;

a first weight coupled to the acting section, the first weight including a passage having a bottom; and a second weight coupled to the bottom of the passage of the first weight.

18. An acceleration sensor as claimed in claim 17, wherein the passage is gradually smaller in width towards the bottom of the passage.

19. An acceleration sensor as claimed in claim 17, wherein the second weight is greater in specific gravity than the first weight.

20. An acceleration sensor as claimed in claim 17, further comprising a third weight covering an opening of the passage of the first weight.

* * * * *